US005975805A

United States Patent [19]

Morvan et al.

[11] Patent Number: 5,975,805

[45] Date of Patent: Nov. 2, 1999

[54] OIL DRILLING RIG SYSTEM

[75] Inventors: Pierre Morvan, Paris; Prasert Sananikone, Beynes, both of France

[73] Assignee: Schlumberger Technology Corporation, Sugar Land, Tex.

[21] Appl. No.: 09/019,962

[22] Filed: Feb. 6, 1998

[30] Foreign Application Priority Data

Feb. 7, 1997 [FR] France ..... 97 01644

[51] Int. Cl.[6] ..... E21B 7/12; E02B 17/08

[52] U.S. Cl. ..... 405/198; 364/528.1; 405/196

[58] Field of Search ..... 405/198, 196, 405/199, 195.1; 114/264, 265; 364/528.1; 254/95, 112

[56] References Cited

U.S. PATENT DOCUMENTS

| | | | |
|---|---|---|---|
| 3,332,663 | 7/1967 | Cargile | 405/198 X |
| 4,269,543 | 5/1981 | Goldman et al. | 405/198 |
| 4,482,272 | 11/1984 | Colin | 405/198 |
| 4,813,814 | 3/1989 | Shibuta et al. | 405/198 |
| 4,885,698 | 12/1989 | Kawasaki | 405/198 X |
| 5,833,396 | 11/1998 | Thomas | 405/196 X |

*Primary Examiner*—Dennis L. Taylor
*Attorney, Agent, or Firm*—Steven L. Christian; Wayne I. Kanak; Peter Y. Lee

[57] ABSTRACT

A method and apparatus of raising or lowering an oil drilling rig mounted on a platform is provided. The rig is mounted on the platform hull, which is supported by a plurality of legs. Each leg has a plurality of jacking chords. The legs are raised or lowered relative to the hull to lower or raise the rig. The elevation of each chord of a leg is measured during the raising or lowering action, and the measured elevations are used to determine the deformation of the leg. In this manner, a corrective action is instituted according to the determined deformation by acting individually on each chord of the leg.

5 Claims, 4 Drawing Sheets

OIL DRILLING RIG SYSTEM

BACKGROUND OF THE INVENTION

1. Field of the Invention

The present invention relates to the technical field of oil drilling, and more particularly to that of drilling rigs of the "jack-up" type, i.e. with the rig raised on legs, using a rack-and-pinion system, after being towed to the site.

2. Description of the Related Art

Such "off-shore" rigs are very well-known and consist schematically of the drilling rig or "hull" proper, which will not be described in detail here, generally mounted on three "legs", generally arranged in a triangle, and each provided with a base forming a supporting foot ("spud can" of the leg). The characteristic of these structures is to be assembled and then towed in a lowered floating state to the drilling site. They are then positioned on the site, and the rig is raised to the "high" position, i.e. to its operational height above the sea. Elevation is carried out by motorized displacement ("jacking") of the rig along each of its legs through "wells" arranged for the purpose. Each displacement along a leg is naturally independent of the others to a certain extent, so that the operator can, for example, correct uneven penetration of the legs into the sea bed. The rig is raised or lowered in relation to each leg by sets of racks-and-pinions mounted on each leg, the systems generally being arranged in each angle or "comer" of the triangular structure with three metal chords and struts ("chord" designating each "member" of each triangular leg). When the position of a given leg is changed, all the pinions of the system relating to this given leg are always in operation simultaneously, in the same direction and with the same theoretical speed. With regard to the speed of linear displacement, on the other hand, this depends on the load, which is one of the problems solved by the invention: when a leg is inclined, the least-loaded chord will be raised more quickly than the others by its motors, hence an additional increase in the RPD [Rack Phase Difference] on the leg concerned. The relative position of the rig (hull) and of the legs (geometry of the system) in relation to the sea bed is checked in relation to two series of fixed reference points, which are the bottom ofthe hull of the rig and the top of the "jacking structure" or "jacking house".

This positioning is, however, rendered difficult by many factors. These factors are also well known. An inclination or deviation may be due in the first instance to incorrect positioning by the operator, or to the existence or appearance of major lateral stresses or loads, such as those due to currents, swell and/or wind, or in particular to uneven embedding of the feet of the legs, or to heterogeneous or inclined ground, or to an operating fault on a lifting motor or brake. However, during operation, it is practically impossible to determine which factors are involved.

A fault of this type is manifested in particular in excessive stresses on the structure and particularly on the legs, with the risk of damage to the legs, to the structure of the leg, which can lead to an accident, and thereby to protracted immobilization of the rig, and to an appreciable reduction of the service life of the rig.

One concern of the industry is therefore to reduce this horizontality defect, referred to as "RPD" or "Rack Phase Difference" (difference for a given rack phase, i.e. geometrical difference in the structure for a given number of rack notches).

Normally, when the rig is on site, the legs are lowered until their tips are resting on the sea bed, then the rig is raised out of the water up to its operating position. This involves a certain penetration of the tips into the sea bed, according to the nature of the bed, but normally the legs remain vertical and the only forces acting on the unit remain within the strength limits selected when designing the rig. However, in certain cases, the sea bed may be inclined or uneven, etc., which can cause a deviation of one or more legs in relation to the vertical, which creates a bending moment on the leg concerned. Naturally, these deviations, if they affect two or three legs, are not necessarily "parallel", which complicates the problem posed. In its turn, such bending causes the load to become unequal on the three chords of the leg concerned, the leg being in a skewed position in its guide ("cock"). The imbalance can be such that it is no longer possible to move the rig. Corrective action is then necessary.

The rig then has to be lowered again to water level, to a floating state to eliminate the load, the supporting legs are withdrawn from the sea bed over a part of the penetration obtained, and then the jacking operation is recommended. This may possibly be combined, according to the seriousness of the situation, with a slight shift of position in order to avoid the first footprints, although such an operation is not generally recommended, and with a backward and forward movement of the legs ("reaming") to correct the deviation. Such action is obviously time consuming and is not always successful. In certain severe situations, a decision has to be made to move the rig from the planned drilling point to another location 50 to 100 meters away, and to recommence the operation, with the same uncertainties. This latter solution is impossible to implement when the rig has to be located alongside a fixed production platform. In such a case, only a margin of a few tens of centimetres is available for jacking up the rig.

It is therefore easy to appreciate the problem faced by the industry, which is to simplify such corrective action and to render it more efficient. The problem is aggravated by the magnitude of the stresses and mechanical forces involved, and by factors such as swell, wind, currents and the like, which can thwart the efforts of the operator. The problem is further complicated by the fact that an action which is as simple and reliable to implement as possible has to be proposed, since any inaccuracy on the part of the operator can cause major damage to the structure.

SUMMARY OF THE INVENTION

According to the invention, what is proposed is a method for raising or lowering an oil drilling rig or the like of the "rack-and-pinion" type ("jack-up rig"), comprising legs of a triangular structure with three chords, or a similar structure, characterized by the fact that the relative position (trim) of the rig (hull) is modified or can be modified in a vertical direction in relation to a calculation of the RPD of each leg, acting independently on any chord of each leg, after measuring the elevation of each chord in relation to a reference point.

Preferably, the said reference point will be the top of the "jack house", i.e. the structure housing the rack-and-pinion system.

An essential characteristic of the invention is therefore to measure the length or extension of each leg under the hull of the rig.

According to a preferred embodiment of the invention, the elevation of each chord is measured in relation to the reference point; the difference is then determined between these measurements for the leg concerned.

Present-day conventional legs are generally in the form of a lattice structure with a triangular or square horizontal section. Each conventional leg therefore has three or four chords. Similarly, conventional rigs have three or four legs of this type.

The invention therefore relates in the first instance to such structures. It is however immediately apparent to a person skilled in the art that the invention applies, mutatis mutandis, to rigs having, for example, five legs, and/or equally to rigs having legs with a different cross-section. In fact, the invention applies to any self-raising rig having several jacking chords per leg.

It will have been understood that the invention relates to the general concept, which is to calculate the RPD through the difference between elevation measurements on each chord of each leg, in order better to appreciate the deformation of the structure and therefore to be in a position to anticipate to a certain extent, and to institute more efficiently and with less risk, a corrective action intended to counteract as well as possible, and if possible perfectly, the bending moment or the like caused by the inequality in the raising or lowering movement, whatever the cause of this irregularity.

A person skilled in the art will appreciate that one of the decisive advantages of the invention is to confer on a well-informed operator this ability to anticipate, which will often make the difference between an efficient corrective action and, on the other hand, an immobilization or a delay, or even an accident.

The invention also relates to equipment and systems for raising or lowering oil drilling rigs or the like of a rack-and-pinion type ("jack-up rigs"), characterized in that they have at least one means for carrying out the said calculation of RPD by integrating a measurement of the elevation of each chord of a given leg in relation to a reference point, independently of the other chords of the same leg.

The invention also relates to equipment and systems for raising or lowering oil drilling rigs or the like of the rack-and-pinion type ("jack-up rigs"), characterized in that they have at least one means for raising or lowering ("jacking") each chord independently of the other chords.

The invention finally relates to rigs equipped with such equipment or systems.

BRIEF DESCRIPTION OF THE DRAWINGS

Other characteristics and advantages of the invention will be better understood by reading the following description and by referring to the appended drawings, in which.

DESCRIPTION OF THE PREFERRED EMBODIMENT

Generally speaking, the two reference planes are the top of the rack-and-pinion housing or JHT ("Jack House Top") and the lower surface of the hull HB ("Hull Bottom"). The distance D separating the JHT from the HB is of course known (in one specific embodiment: 14.576 m).

The invention therefore consists in determining the RPD as accurately and simply as possible, by integrating a measurement of the elevation of each chord of each leg, in comparing them with the tolerances and, in the event of the tolerances being exceeded, or well before they are exceeded if one succeeds in predicting this, in carrying out a corrective action.

Measurement and Calibration of the RPD

Figure 1:
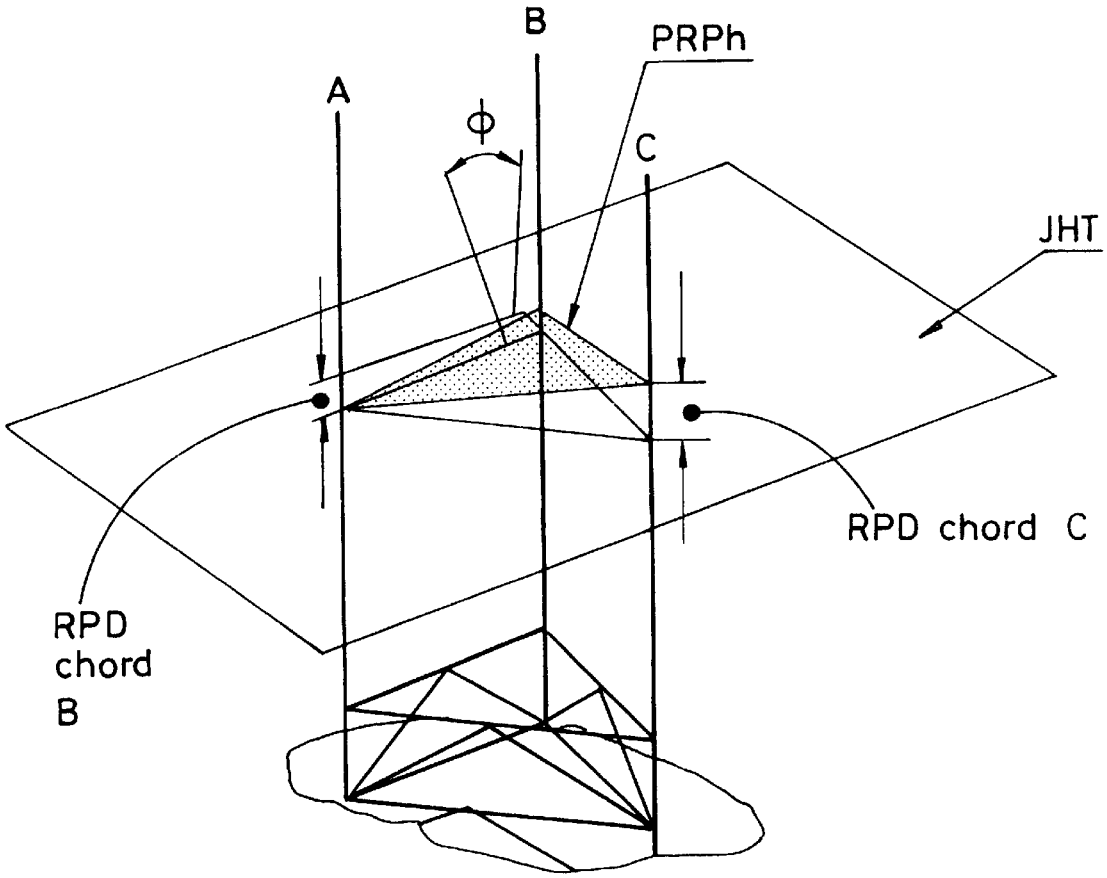
FIG. 1 represents a leg with three chords A, B and C, and shows the JHT plane of the structure of the rack-and-pinion platform ("Jack House Top plane") and the PRPh defined by three points of the three chords which, at a given instant, are in the same "Rack Phase", i.e. correspond to the movement defined by the same number of rack notches; the difference between the two planes is the resultant of the deformation of the chord ("true RPD") and of the rotation of the chord in the jacking unit.
Figure 2:
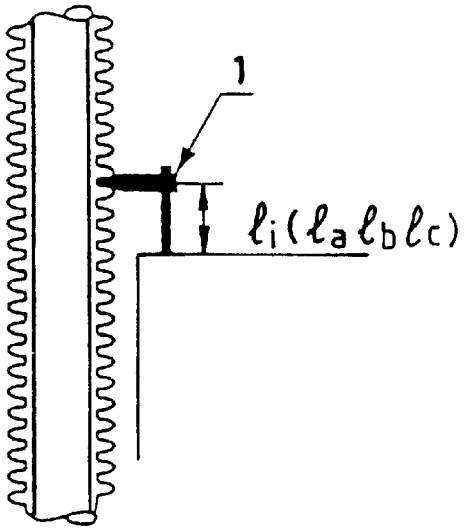
FIG. 2 represents a rack-and-pinion detail and measurement of the "measured RPD" using a manual RPD gauge.

With reference to FIG. 1 and FIG. 2, the values $l_i$ ($l_a$; $l_b$; $l_c$) are measured for each chord A, B and C, using manual gauges (1) as shown in FIG. 2, or using systems connected to the electric motors and displaying data in the control room. The measured RPD is obtained.

The value "0" is assigned to the measurement corresponding to the chord exhibiting the highest measured value on each leg.

A reading of the "leg depth" is taken on the three chords of a leg, and the chord which is regarded as being at the same level as the top of the jacking unit ("Jacking Unit Top") is marked. The leg depth mark is determined by a direct reading of graduations indicating the distance between the leg tip ("spud can") and the bottom of the hull. Sensors connected to the motors can likewise give the same indication in the control room.

Figure 4:
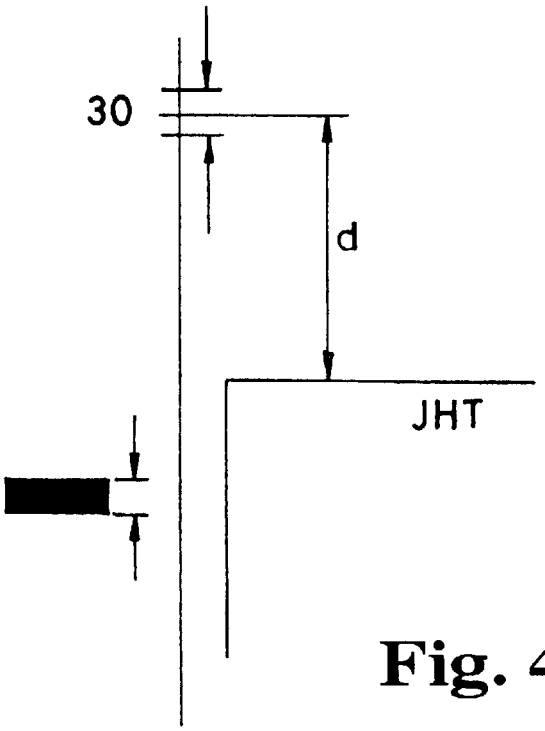
FIG. 4 represents a measurement of the CDM [Close Depth Mark].
Figure 3:
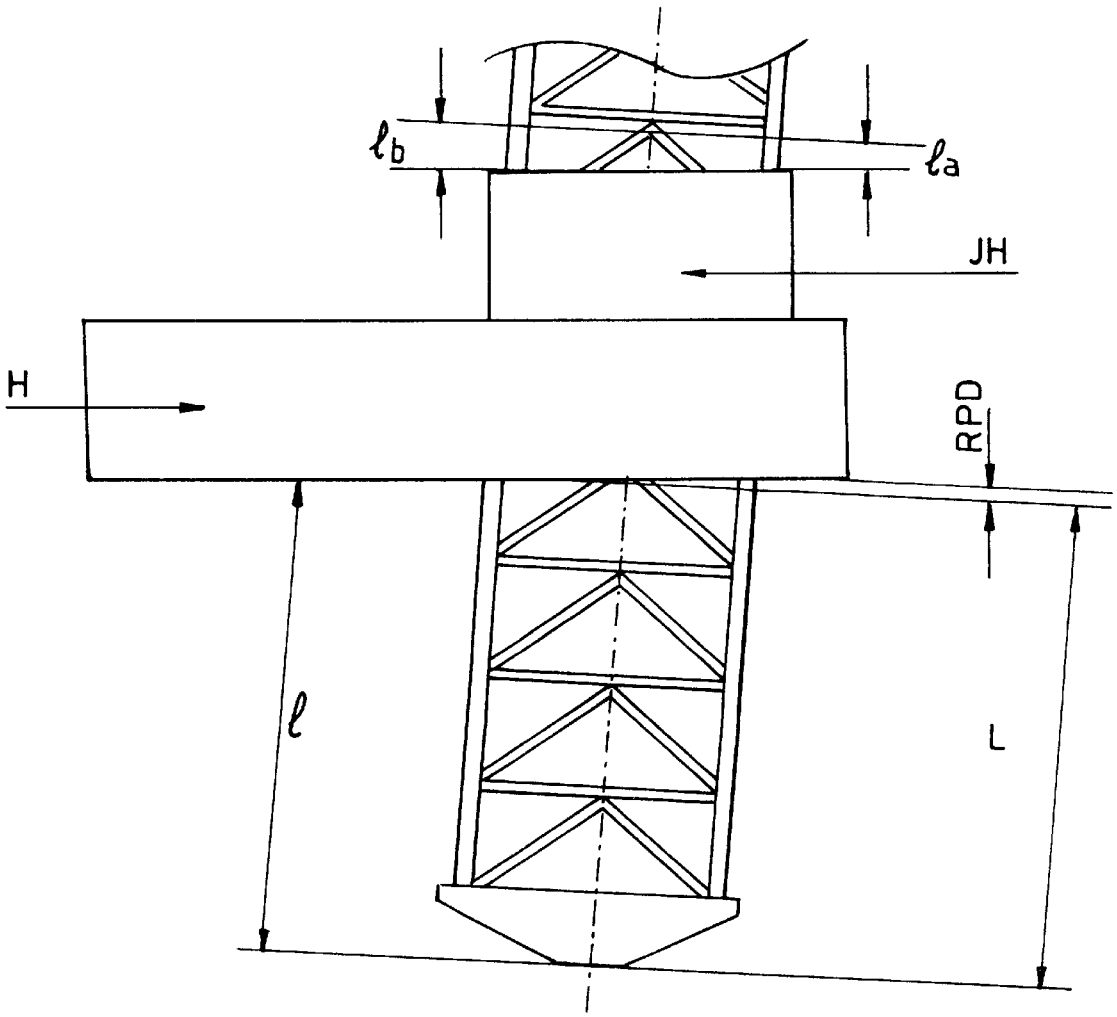
FIG. 3 diagrammatically represents the essential elements of the rig to be considered according to the invention: JH represents the "Jack House"; H represents the "Hull"; l is the extension of the leg on chord B having the minimum extension; and L is the extension of the leg on chord C; the angle $\phi$ represents the angle of tilt.

By reference to FIG. 4, a distance (d) from the jacking unit top (JHT) to the center of the close depth mark is measured using a gauge located in the hollow of each indentation of the rack, and the said "Close Depth Mark" (CDM) is also read.

The mark (LJ) corresponding to the jacking house top JHT is obtained by carrying out: CDM−d.

The extension (L) of the chords is obtained using following formulae:

$$L=LJ-D$$

(example: D=14.576 m)

or $$L=(CDM-d)-D$$

The extension of the other two chords is calculated from the bias/skeew of the values $\mathbf{1}_i$ of the measured RPD, as follows:

CHORD #1 (leg depth marks on chord C):

$$L(\text{chord A})=L(\text{chord C})+l_c-l_a$$

$$L(\text{chord B})=L(\text{chord C})+l_c-l_b$$

CHORDS #2 & 3 (leg depth marks on chord A):

$$L(\text{chord B})=L(\text{chord A})+l_a-l_b$$

$$L(\text{chord C})=L(\text{chord A})+l_a-l_c$$

The RPD can be calculated directly from the values of $l_i$, i.e. $l_a$, $l_b$ and $l_c$:

$$\text{RPD(chord A)}=\max.\ (l_a, l_b, l_c)-l_a$$

$$\text{RPD(chord B)}=\max.\ (l_a, l_b, l_c)-l_b$$

$$\text{RPD(chord C)}=\max.\ (l_a, l_b, l_c)-l_c$$

The invention also encompasses equipments and systems for raising lowering ("jacking") a jack-up rig, which are designed according to the invention, as well as the jack-up rigs equipped with the said system and equipments.

Figure 5:
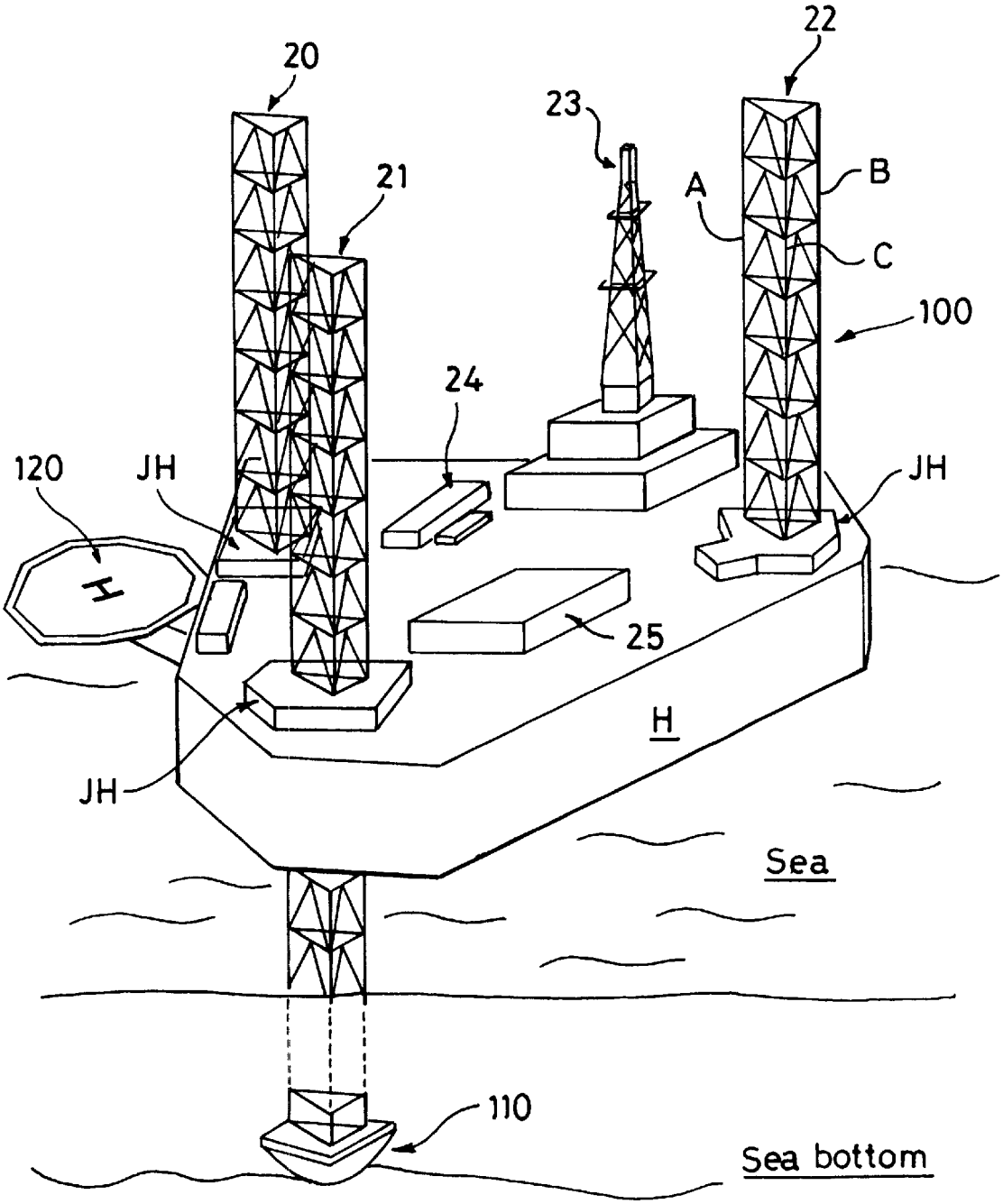
FIG. 5 represents in a schematic way ajack-up rig equipped with three legs, each having three chords.

A jack-up rig 100 is schematically represented on FIG. 5. The platform comprises in a known manner a hull H supported by three legs 20, 21 and 22. Each leg can be jacked up or down by rack and pinion units (not shown) housed in jack houses JH. Each leg comprises three chords A, B, C as defined herein, and a spud can 110 which lays on the sea bottom. Various structures are mounted on the platform, such as 24, 25 shown only for illustration purposes. A drilling rig 23 is mounted on the platform. An helicopter platform 120 is generally placed on the platform.

The equipments and systems according to the invention, allowing operation of the method according to the invention, as described above, can be conveniently housed in the jack houses JH and/or any other appropiate location 24, 25 on the platform.

Such platforms are well known to the skilled man, who will be able to place the equipment an systems of the invention in the most convenient manner.

We claim:

1.A method of raising or lowering an oil drilling rig mounted on a platform having a hull supported by a plurality of legs, each leg having a plurality of jacking chords, the method comprising the steps of:

raising or lowering the plurality of legs relative to the hull to lower or raise the rig;

measuring the elevation of each chord of a leg during the raising or lowering step;

determining the deformation of the leg from the measured elevations; and instituting a corrective action according to the determined deformation by acting individually on each chord of the leg.

2. The method of claim 1, wherein the determined deformation is expressed as a Rack Phase Difference.

3. The method of claim 2, wherein the Rack Phase Difference is determined by using the measured elevation of one chord of the leg as a zero level and the measured elevations of the other chords of the leg define elevational differences from the one chord.

4. An oil drilling platform, comprising:

a hull supported by a plurality of legs, each of the legs having a plurality ofjacking chords; and a plurality of systems for independently raising and lowering each chord of each leg relative to said hull to induce a corrective action according to a measured deformation of each leg.

5. The platform of claim 4, wherein the deformation is expressed as a Rack Phase Difference.

* * * * *